US010392572B2

(12) United States Patent
Tsang

(10) Patent No.: US 10,392,572 B2
(45) Date of Patent: Aug. 27, 2019

(54) STANDPIPE-FLUID BED HYBRID SYSTEM FOR CHAR COLLECTION, TRANSPORT, AND FLOW CONTROL

(71) Applicant: Lummus Technology Inc., Bloomfield, NJ (US)

(72) Inventor: Albert C. Tsang, Sugar Land, TX (US)

(73) Assignee: Lummus Technology Inc., Bloomfield, NJ (US)

( * ) Notice: Subject to any disclaimer, the term of this patent is extended or adjusted under 35 U.S.C. 154(b) by 0 days.

(21) Appl. No.: 15/007,538

(22) Filed: Jan. 27, 2016

(65) Prior Publication Data

US 2016/0222306 A1 Aug. 4, 2016

Related U.S. Application Data

(60) Provisional application No. 62/109,843, filed on Jan. 30, 2015.

(51) Int. Cl.
*C10J 3/46* (2006.01)
*C10J 3/48* (2006.01)
(Continued)

(52) U.S. Cl.
CPC ..... *C10J 3/506* (2013.01); *C10J 3/466* (2013.01); *C10J 3/485* (2013.01); *C10J 3/523* (2013.01); *C10J 3/723* (2013.01); *C10J 3/84* (2013.01); *C10K 1/02* (2013.01); *C10K 1/026* (2013.01); *C10J 2300/094* (2013.01); *C10J 2300/0933* (2013.01); *C10J 2300/0943* (2013.01);
(Continued)

(58) Field of Classification Search
CPC ..... C10J 3/00
See application file for complete search history.

(56) References Cited

U.S. PATENT DOCUMENTS 3,353,925 A 11/1967 Baumann et al.
4,032,305 A 6/1977 Squires
(Continued)

FOREIGN PATENT DOCUMENTS

CN 2180643 Y 10/1994
CN 101942344 B 10/2013
(Continued)

OTHER PUBLICATIONS

International Search Report and Written Opinion dated Jul. 1, 2016 in corresponding PCT application No. PCT/US2016/014563 (16 pages).
(Continued)

*Primary Examiner* — Matthew J Merkling
(74) *Attorney, Agent, or Firm* — Osha Liang LLP

(57) ABSTRACT

A system for gasification of a carbonaceous material and recycling char or solids from a gasifier is disclosed. The recycling system may include a standpipe that receives a solids stream from a separator, the standpipe generating a pressure differential across a bed of accumulated char, thereby producing a bottoms stream having a greater pressure than the inlet solids stream. The recycling system may also include a holding vessel that receives the bottoms stream and a fluidized-bed distribution vessel that receives char from the holding vessel and is configured to provide a continuous and precise flow of recycled char to the gasification reactor.

17 Claims, 2 Drawing Sheets

(51) Int. Cl.

| | |
|---|---|
| ***C10J 3/50*** | (2006.01) |
| ***C10J 3/52*** | (2006.01) |
| ***C10J 3/72*** | (2006.01) |
| ***C10J 3/84*** | (2006.01) |
| ***C10K 1/02*** | (2006.01) |

(52) U.S. Cl.
CPC ..... *C10J 2300/0959* (2013.01); *C10J 2300/1807* (2013.01)

(56) References Cited

U.S. PATENT DOCUMENTS

| | | | | |
|---|---|---|---|---|
| 4,300,914 | A * | 11/1981 | Rice | C10J 3/54 201/31 |
| 6,457,425 | B1 | 10/2002 | Crafton et al. | |
| 2010/0101146 | A1 | 4/2010 | Fujimori et al. | |
| 2011/0146152 | A1 | 6/2011 | Vimalchand et al. | |
| 2012/0111109 | A1 | 5/2012 | Chandran et al. | |
| 2013/0041195 | A1 | 2/2013 | Pelton | |
| 2013/0140168 | A1* | 6/2013 | Koyama | B65G 53/18 202/261 |

FOREIGN PATENT DOCUMENTS

| | | | |
|---|---|---|---|
| JP | H04-088086 | A | 3/1992 |
| JP | H04-503526 | A | 6/1992 |
| JP | 2000-248284 | A | 9/2000 |
| JP | 2012-126571 | A | 7/2012 |
| JP | 2013-57048 | A | 3/2013 |
| JP | 2013-227397 | A | 11/2013 |
| WO | 2015039731 | A1 | 3/2015 |

OTHER PUBLICATIONS

Extended European Search Report issued in corresponding European Application No. 16743889.4 dated Jul. 10, 2018 (11 pages).

Office Action issued in corresponding Japanese Application No. 2017-540139 dated Jul. 31, 2018, and English translation thereof (14 pages).

Office Action issued in corresponding Japanese Application No. 2017-540139 dated Jun. 18, 2019, and English translation thereof (18 pages).

* cited by examiner

STANDPIPE-FLUID BED HYBRID SYSTEM FOR CHAR COLLECTION, TRANSPORT, AND FLOW CONTROL

CROSS-REFERENCE TO RELATED APPLICATION

This application, pursuant to 35 U.S.C. § 119(e), claims benefit to U.S. Provisional Application Ser. No. 62/109,843 filed Jan. 30, 2015. This application is incorporated herein by reference in their entirety.

FIELD OF THE DISCLOSURE

Embodiments disclosed herein relate generally to a gasification system and processes for converting generally solid feedstocks, such as carbonaceous materials, into desirable gaseous products, such as synthesis gas.

BACKGROUND

Gasification processes are widely used to convert solid or liquid feedstocks such as coal, petroleum coke and petroleum residue into synthesis gas (syngas). Syngas is an important intermediate feedstock for producing chemicals such as hydrogen, methanol, ammonia, synthetic natural gas or synthetic transportation oil, or as a fuel gas for power generation.

A common practice for gasification processes is to recycle unreacted char back to the gasification reactor using a complex system of lock-hoppers, which generally includes multiple vessels connected in series, where each vessel can be individually pressurized and de-pressurized. These systems are typically used for transferring solids from a low pressure to a higher pressure environment. However, because of the frequent cycling and batch operations, lock-hoppers are very maintenance intensive, contributing to the high cost of operating such a system. In addition, there is a higher capital cost associated with the use of multiple vessels, valves, and instrumentation. Gas consumption, recycling, and management for pressurization and de-pressurization of the lock-hoppers is an additional factor for consideration.

As an alternative to lock hoppers, rotary valves have also been used for transferring solids from a low pressure environment to a higher pressure environment. However, high erosion wear in the rotor, especially for applications involving fine abrasive solids like char, is a serious problem.

SUMMARY OF THE CLAIMED EMBODIMENTS

Embodiments disclosed herein relate to a lower maintenance system that can be operated continuously, via which the flow rate of recycled char can be precisely metered and controlled, and which will be able to efficiently and effectively transport the solids from a lower pressure environment to a higher pressure environment.

In one aspect, embodiments herein are directed toward a system for gasification of a carbonaceous material. The system may include a gasification reactor for the gasification of a carbonaceous material, producing an overhead product stream containing char and syngas. The system may also include a separator for separating the overhead product stream into a solids stream including the char and a gas stream including the syngas. The system may also include a subsystem for recycling the solids stream to the gasification reactor. The recycling system may include a standpipe that receives the solids stream from the separator for generating a pressure differential across a bed of accumulated char, thereby producing a bottoms stream comprising char having a greater pressure than the solids stream. The recycling system may also include a holding vessel that receives the bottoms stream and a fluidized-bed distribution vessel that receives char from the holding vessel and is configured to provide a continuous and precise flow of recycled char to the gasification reactor.

In another aspect, embodiments herein are directed toward a system for gasification of a carbonaceous material. The system may include: a gasification reactor, for the gasification of a carbonaceous material producing an overhead product stream containing char and syngas, and a separator for separating the overhead product stream into a solids stream including the char and a gas stream including the syngas. The system may also include a subsystem for recycling the solids stream to the gasification reactor. The recycling system may include a standpipe that receives the solids stream from the separator and is configured for generating a pressure differential across a bed of accumulated char and for partially fluidizing a bottom portion of the bed of accumulated char to provide a continuous flow of recycled char to the gasification reactor.

In yet another aspect, embodiments herein are directed toward a process for recycling char to a gasification reactor. The process may include: separating a gasification reactor effluent including char and syngas to produce a solids stream including the char and a vapor stream including the syngas. The char in the solids stream may be fed to a standpipe, and an amount of char may be accumulated within the standpipe to generate a pressure differential, such that the char may be recycled to the gasification reactor.

Other aspects and advantages will be apparent from the following description and the appended claims.

DETAILED DESCRIPTION

Figure 1:
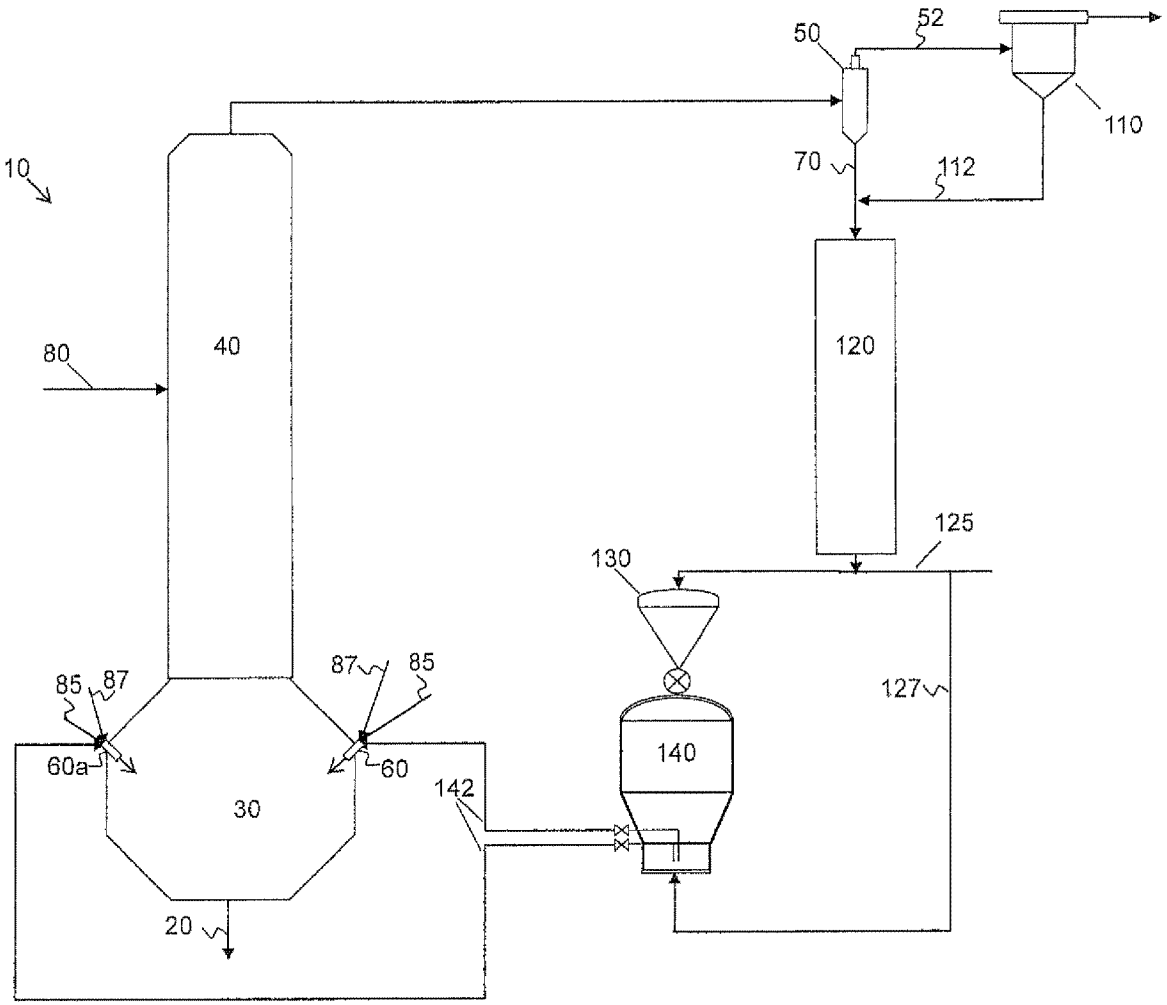
FIG. 1 is a simplified process flow diagram of a gasification system including a char recycling system according to embodiments disclosed herein.

In one aspect, embodiments herein relate to a process for the conversion of carbonaceous material to synthesis gas (syngas). In solid fuel gasification processes, a large quantity of dried and partially reacted particles, called char, may be entrained in a syngas produced in the gasification reactor. This char, which may include ash and unconverted carbon, needs to be separated, transported, and recycled back to the gasifier for final consumption, producing additional syngas and slag. For example, the char may be injected back into the gasifier with an oxidant such as air or oxygen through a burner or burners. The char/oxidant ratio for each burner needs to be controlled so that the gasifier does not operate at too low or too high a temperature. Too low a temperature results in incomplete conversion of the char, while too high a temperature may damage the refractory lining on the gasifier. Therefore, it is desired to maintain a steady char flow rate so that a precise amount of oxidant may be added to the burners. This may be accomplished with a standpipe-fluid bed hybrid recycle systems as described herein. Unlike lockhoppers, which consist of multiple vessels with frequent cycling, standpipe-fluid bed hybrid recycle systems described herein can increase the pressure of a solids recycle stream while advantageously maintaining a continuous, metered flow. The ability to provide a continuous, measurable, and controllable flow provides several advantages to the system, described further below. As noted briefly above, as used herein the term "char" refers to unconverted or partially converted carbonaceous particles and ash particles that may remain entrained within a gasification reactor effluent.

Systems and processes for gasification of a carbonaceous material according to embodiments herein may include a gasification reactor, or gasifier, for gasifying a carbonaceous material to produce a product stream comprising syngas and entrained char. Gasifiers useful in embodiments herein may include single stage or multi-stage gasifiers, such as a two-stage described below, where a fresh carbonaceous feed is introduced to a gasifier upper section, and recycled char is introduced to a gasifier lower section. The carbonaceous feed can be in the form of pulverized fine solids or fine particles suspended in a water slurry.

A separator, such as a cyclone separator, may be used to separate entrained char from the syngas. The entrained char recovered from the separator, which may include unconverted carbonaceous material, may then be recycled to the gasifier for production of additional syngas. The syngas recovered from the separator may also include a small amount of char, and a second separator, such as a cyclone separator or a filter system, may be used to remove additional char from the syngas, where the additional char may also be recycled to the gasifier.

Process dynamics result in a pressure drop between the gasification reactor and the solids outlet of the separators. As a result, recycle of the char requires a method to increase pressure to flow the char back to the gasification reactor. The abrasive properties of the char, however, affects reliability of systems that operate via pressurization and depressurization, and it is generally undesirable to use a liquid slurry system to recycle the char, as the amounts of liquid may adversely impact gasification reactor operations and conversion efficiency.

Recycle systems as described herein, including a standpipe, have been found to provide adequate pressurization of the recovered char to facilitate recycle to the gasification reactor. Standpipes, as used herein, may include relatively tall vessels, such that accumulation of char within the standpipe may produce a differential pressure, where the weight of accumulating particles causes the pressure at the bottom of the standpipe to be greater than the pressure at the top of the standpipe, facilitating transfer of the char back to the gasifier. For example, standpipes according to embodiments herein may have a height of 30 feet, 50 feet, 70 feet, 100 feet or greater, providing for a pressure build of 3 psi, 5 psi, 7 psi, 10 psi, 12 psi, 14 psi, or greater, as may be necessary for the transport of char through the recycle system. In some embodiments, standpipes according to embodiments herein may have a height sufficient to allow a pressure build in the range from about 3 psi to about 15 psi, such as in the range from about 5 psi to about 9 psi.

The required pressure build may depend upon the gasification system being used and the differential pressure needed to facilitate the solids transport and injection into the gasifier. Additionally, the realized pressure build may depend upon the properties of the char, which may in turn depend upon the type of carbonaceous feedstock being processed, operating conditions (e.g., temperature and pressure) within the gasification reactor, and the size, packing density, and porosity of the resulting char particulates, among other factors.

The overall system design may be configured for a consistent carbonaceous feedstock, or may be configured to operate with multiple carbonaceous feedstocks. For example, as compared to a high grade coal, a lower grade coal may be fed to an upper stage of a two-stage gasification reactor using a water slurry with a relatively high content of water. This, in turn, may result in a lower outlet temperature at the top of the upper reaction zone and a significantly greater amount of entrained char to be separated and recycled, and depending upon the differences in coal grades, could result in as much as ten times the amount of char recycle. Systems according to embodiments herein, utilizing a standpipe, may provide for efficient, continuous, measurable, recycle of char to a gasification reactor. For example, the char may be introduced to a lower section of a two-stage gasification reactor, the lower section processing char only or a mixture of char and carbonaceous material. Embodiments herein provide for feed of the recycle char as a dense phase, with limited amounts of fluidization medium, such as syngas, nitrogen, carbon dioxide, or other suitable fluidization gases. Carbon dioxide, a recoverable byproduct from the gasification process, may be used in particular embodiments.

Dense phase transport is preferred over dilute phase transport because of the amount of gas required to entrain the solids. For a dilute phase transport system, it may require 2 pounds of fluidization gas per pound of solid while a solid dense phase system may require only 0.02 pounds of fluidization gas per pound of the same solid, for a one hundred fold difference in the amount of gas required to entrain the solids. Also, the velocity of transport in a dilute phase transport system is in excess of 40 feet per second while it may be less than 20 feet per second in a dense phase system. The high transport velocity in the dilute phase system coupled with the entrained abrasive solids causes severe erosion problems in the piping system. If the recycle char is the primary feed to the gasifier reaction chamber, the huge volume of entrainment gas associated with a dilute phase transport system that will be fed with the recycle char to the gasifier makes the dilute phase transport system impractical to use. The ability to continuously recycle char to the gasification reactor as a dense phase afforded by the standpipe may advantageously provide for ease in reactor control and flexibility in feedstock.

Referring now to FIG. 1, a simplified process flow diagram of a gasification system according to embodiments herein is illustrated. As illustrated in FIG. 1, a gasification reactor 10 includes a reactor lower section 30 and a reactor upper section 40. The first stage of the gasification process takes place in the reactor lower section 30 and the second stage of the gasification process takes place in the reactor upper section 40. The reactor lower section 30 defines the first stage reaction zone, and will alternatively be referred to as the first stage reaction zone. The reactor upper section 40 defines the second stage reaction zone, and will alternatively be referred to as the second stage reaction zone. While described with respect to a two stage gasifier, embodiments disclosed herein may be operated with other gasifiers.

According to the embodiment depicted in FIG. 1, solid feedstock may be pulverized (not shown) or ground and slurried as in a coal-water slurry before entering the system. The pulverized solid stream of particulate carbonaceous material, such as pulverized coal or ground and slurried carbonaceous material such as coal-water slurry, is injected into the gasification reactor upper section 40 through feeding device 80, and/or additional feeding devices (not shown). The carbonaceous material then comes into contact with a hot syngas, such as at a temperature between 2300° F. and 2900° F., rising from the gasification reactor lower section 30. The slurry or carbonaceous material is dried and a portion of it is converted via pyrolysis into syngas. Water evaporation and pyrolysis reactions are endothermic, thus the temperature of the mixture of carbonaceous material and syngas decreases as the mixture travels upwards through the reactor upper section 40. By the time the second mixture product, including unreacted solid particulates (e.g. char) and a gaseous product (e.g. syngas), leaves the top of the reactor upper section 40, the mixture product temperature may decrease, such as to a temperature in the range from about 400° F. to about 1900° F. The temperatures actually used may depend on the feedstock and particular reactor configuration.

The mixture product, including entrained solid particulates and a gaseous product, exits the reactor upper section 40 and is sent to a cyclone separator 50. The cyclone separator 50 splits the mixture product into a solid product stream, including the unreacted solid particulates, and a gaseous product stream, leaving only a small fraction of residual solid fines in the gaseous product stream. The solid product stream exits the cyclone separator 50 via an outlet 70.

The solid product recovered from the bottom of cyclone separator 50 is then fed to the top of standpipe 120. The solids accumulate and concentrate within standpipe 120. The height of accumulated solids in the standpipe results in the pressure build at the bottom of the standpipe. The accumulated solids are then transported from the bottom of standpipe 120 to a holding vessel 130 via flow line 125. The accumulated solids may be transported continuously or semi-continuously in various embodiments, and may be transported by gravity or via dense phase transport with a minimal amount of syngas, carbon dioxide, or nitrogen, for example, which may be introduced via flow line 126.

Holding vessel 130 may be disposed above a fluidized-bed distribution vessel 140, and may be used to facilitate transport of the char back to the gasifier via flow lines 142 as well as to facilitate measurement of the flow rate of char to the gasifier. For example, holding vessel 130 may be periodically opened to feed the solids into fluidized-bed distribution vessel 140 for recycle back to the reactor lower section 30, where a flow rate of solids may be determined by a drawdown in volume of particles within fluidized-bed distribution vessel 140, or a differential weight of fluidized-bed distribution vessel 140. Alternatively, commercially available solids flow meters used on lines 142 may be used to measure the flow rate of recycled char, where holding vessel 130 may facilitate periodic calibration of the flow meters via drawdown of particles within fluidized-bed distribution vessel 140. Holding vessel 130, while disposed above fluidized-bed distribution vessel 140, is independently supported, such that solids accumulating in holding vessel 130 do not affect the weight determination during drawdown of fluidized-bed distribution vessel 140 where a differential weight is required.

The standpipe 120, which is a length of pipe through which the solid product flows by gravity, may be used to transfer solids from a low pressure area, such as cyclone 50, to a higher pressure area, such as gasification reactor 10. The pressure available at the bottom outlet of standpipe 120 is dependent on the height of the standpipe, the height of the solids level in the standpipe, the characteristic of the solid (i.e., density, porosity, particle size distribution, packing efficiency, etc.), and how much gas is entrained in the solids, among other factors. Typically, with coal type carbonaceous materials, one can expect a pressure build-up of approximately 1-2 psi for every 10 feet of height of the standpipe. Therefore, with a 70-foot tall standpipe, the pressure of the solids exiting the bottom of the standpipe would be higher by approximately 7-14 psi relative to the top of the standpipe. For a two-stage gasification reactor, such as depicted in FIG. 1, depending on the pressure drop across the solids transport line, burner (or dispersion device), gasifier, and cyclone, standpipe 120 may have a height at least half the height of upper reaction section 40, for example, and in some embodiments may have a height at least equivalent to that of upper reaction section 40.

Fluidized-bed distribution vessel 140 is used to transport and recycle char into the bottom of gasification reactor 10 through one or more transport lines 142 to one or more dispersion devices 60 and/or **60*a* on the reactor lower section 30. A fluidization medium, such as nitrogen or syngas fed via flow line 127, may be introduced to fluidized-bed distribution vessel 140 to fluidize and transport the solids. Typically, the lengths and configuration of the transport lines 142 between the fluidized-bed distribution vessel 140 and the dispersion devices 60 and/or 60*a* are adjusted so that the differential pressure drop for each line are the same, to ensure similar flow rates in each line. The pressure drop in the transport lines may be, for example, about 1-2 psi per 10 feet of piping. The pressure drop through the transport line may be used as a built-in restricting orifice to regulate the flow rate. Therefore, by varying the bed density in the fluidized-bed distribution vessel 140 by adjusting the amount of fluidization medium, the solids flow rate through the lines can be regulated, thereby eliminating the need for a flow control valve which typically needs a much higher differential pressure (e.g., 10-15 psi) to operate. The pressure drop in such a fluidized-bed distribution vessel 140 may be kept very low. By combining the standpipe 120, holding vessel 130, and the fluidized-bed distribution vessel 140**, solids may be transferred from a lower pressure to a higher pressure region without the use of lock-hoppers.

Measurement of solids flow rate by flow meters can be challenging. There are flow meters used in the field that employ a capacitive principle to measure the density of the solids medium flowing through the pipe and its traveling velocity to calculate the mass flow rate. Such a flow meter does not work well for solids that are not very conductive, such as carbonaceous material and char that has a very low ash or mineral content such as petroleum coke. In contrast, systems according to embodiments herein may include solids flow measurements by gravimetric measurements, such as by weight loss or volume loss. For example, fluidized-bed distribution vessel 140 may be mounted on weight cells to monitor the rate of weight loss, or fitted with externally-mounted radiation-based sensors to monitor the bed level and therefore, the volume change. With the fluidized-bed distribution vessel 140 feed system, the solids material may be batched into the fluidized-bed distribution vessel 140 via holding vessel 130 so that weight loss (and therefore the flow rate of char to the burner) can be monitored. Similarly, for a char of known properties (density, packing density, etc.), volume loss may provide a sufficiently accurate measurement of recycled solids flow rate. Systems herein may additionally include one or more sample ports for withdrawing samples of char to determine the properties of the char.

In order to combine the standpipe 120 with the fluidized-bed distribution vessel 140, the holding vessel 130 is used to connect and to act as the interface between the two systems. This holding vessel 130 may be located directly on top of the fluidized-bed distribution vessel 140 and may be separated from the holding vessel 130 by an automated full-port quick opening valve, for example. Pressure in the holding vessel 130 will be the same or slightly higher than in the fluidized-bed distribution vessel 140. During operation, solid flows from the standpipe 120 into the holding vessel 130, with a valve located at the outlet of holding vessel 130 initially closed. When the holding vessel 130 is full, the valve will open and solids in the holding vessel 130 empty into the fluidized-bed distribution vessel 140. The valve will then close and the cycle will be repeated. No pressurization or de-pressurization of the holding vessel 130 is necessary. The solids flow from the fluidized-bed distribution vessel 140 through each transport line 142 and respective burners (or dispersion devices) will be uninterrupted, even during the solids transfer from the holding vessel 130.

The flow rate may be monitored gravimetrically by weight cells or volumetrically by radiation-based sensors fitted on the fluidized-bed distribution vessel 140. The weight or volume is reset after each solids transfer from the holding vessel 130, after which a differential weight or volume loss over time may be used to determine the rate of flow of solids from fluidized-bed distribution vessel 140 to the gasifier 10. Alternatively, as noted above, a solids flow meter can be installed at the outlet of the fluidized-bed distribution vessel 140 or on each individual transport line 142 from the vessel to the burners. If the solids flow meter is used to monitor the solids flow rate independently, the bottom valve on the holding vessel 130 can be left open at all times, and solids can flow directly from the standpipe 120, through the holding vessel 130, and into the fluidized-bed distribution vessel 140. The holding vessel 130 and the bottom valve will be used only when calibration of the solids flow meter is desired, such as once or twice a day or as frequently as desired.

The solid product stream is then recycled back to the reactor lower section 30 of the gasifier 10 through dispersion devices 60 and/or 60*a*. These devices mix the recycled solids with gaseous oxidant, such as air or oxygen, during addition of the solids and oxidant to the first stage of the reactor. The flow rate of oxygen or air, and thus the temperature of the gasifier, may be based at least in part on the flow rate of solids from fluidized-bed distribution vessel 140 to gasifier 10.

The solid product stream (primarily including char) reacts with oxygen in the presence of superheated steam in the reactor lower section 30 (or first stage reaction zone) of the gasification reactor 10. These exothermic reactions raise the temperature of the gas in the first stage to between 1500° F. and 3500° F., for example. The hot syngas produced in the reactor lower section 30 flows upward to the reactor upper section 40 where it comes into contact with the carbonaceous solid or slurry feedstock. The water content is evaporated and the feedstock particles are dried and heated to an elevated temperature by the hot syngas, then the dry particles react with steam to generate CO and hydrogen.

Again referring to the embodiment as shown in FIG. 1, the temperature of the first stage is generally higher than the ash melting point. Consequently, entrained ash particles melt, agglomerate and become a viscous molten slag that flows down the sides of the gasifier to exit the reactor via the reactor outlet 20 and enter a quench chamber (not shown). The slag is water-quenched and ultimately collected as a solid slag product. Water is fed as steam to the lower section 30 of the gasification reactor 10 via dispersion devices 60 and/or 60*a*, or through separate dispersion devices. The water may be from storage tanks (not shown) or from a water utility.

Further referring to FIG. 1, the gaseous product stream 52 exiting from the cyclone separator 50 may include hydrogen, carbon monoxide, carbon dioxide, moisture (water vapor), a small amount of methane, hydrogen sulfide, ammonia, nitrogen and a small fraction of residual solid fines. The gaseous product is subsequently introduced into a particulate filtering device 110, such as a cyclonic filter or candle filters, whereby the residual solid fines and particulates are removed and recycled back to lower section 30 of the gasification reactor 10, via stream 112. Alternatively, the residual solids may be fed to standpipe 120 for recycle to gasification reactor 10.

In certain embodiments, such as illustrated in FIG. 1, the recycled char fed via streams 142, a stream of an oxygen-containing gas fed via streams 85 may be mixed or separately fed through one or more, and steam fed via streams 87 may enter the gasification reactor lower section 30 through one or more dispersion devices 60, 60*a*. More than two dispersion devices can be used, for example, four arranged 90 degrees apart. The sets of dispersion devices can also be on different levels and need not be on the same plane.

Again referring to the embodiments depicted in FIG. 1, the unfired reactor upper section 40 connects directly to the top of the fired reactor lower section 30 so that the hot reaction products are conveyed directly from the reactor lower section 30 to the reactor upper section 40. This minimizes heat losses in the gaseous reaction products and entrained solids, thereby increasing process efficiency.

Further referring to the embodiments depicted in FIG. 1, the dispersion devices 60 and 60*a* provide a dispersed feed of the particulate solids such as char. The dispersion devices may be of the type having a central tube for the solids and an annular space surrounding the central tube containing the dispersion gas which opens to a common mixing zone internally or externally. Further, the feeding device 80 of the unfired reactor upper section 40 may also be similar to the dispersion devices described hereinabove.

The materials used to construct the gasification reactor 10 may vary. For example, the reactor walls may be steel and lined with an insulating castable or ceramic fiber or refractory brick, such as a high chrome-containing brick in the reactor lower section 30 and a dense medium, such as used in blast furnaces and non-slagging applications in the reactor upper section 40, in order to reduce heat loss and to protect the vessel from high temperature and corrosive molten slag as well as to provide for better temperature control. Use of this type of system may provide the high recovery of heat values from the carbonaceous solids used in the process. Optionally and alternatively, the walls may be unlined by providing a "cold wall" system for fired reactor lower section 30 and, optionally, unfired upper section 40. The term "cold wall", as used herein, means that the walls are cooled by a cooling jacket with a cooling medium, which may be water or steam. In such a system, the slag freezes on the cooled interior wall and thereby protects the metal walls of the cooling jacket against heat degradation.

The physical conditions of the reaction in the first stage of the process in the slagging gasifier reactor lower section 30 are controlled and maintained to assure rapid gasification of the char at temperatures exceeding the melting point of ash to produce a molten slag from the melted ash having a viscosity not greater than approximately 250 poises. This slag drains from the reactor through the taphole 20, and may be further processed.

The physical conditions of the reaction in the second stage of the gasification process in the reactor upper section 40 are controlled to assure rapid gasification and heating of the carbonaceous feedstock, and in some embodiments may include heating of the coal above its range of plasticity. Some two stage gasification reactors may, however, control the temperatures in the reactor upper section 40 to be below the range of plasticity of the coal. The temperature of the reactor lower section 30 is maintained in a range between 1500° F. and 3500° F., or may be maintained in a range between 2000° F. and 3000° F. Pressures inside both the reactor upper section 40 and lower section 30 of the gasification reactor 10 are maintained at atmospheric pressure to 1000 psig or higher. The conditions in the upper reaction zone may impact not only the extent of reaction, but the favored reactions as well, and thus care should be used when selecting the operating conditions, so as to provide a desired product mixture from a particular carbonaceous feedstock.

As used herein, the term "oxygen-containing gas" that is fed to the reactor lower section 30 is defined as any gas containing at least 20 percent oxygen. Oxygen-containing gases may include oxygen, air, and oxygen-enriched air, for example.

Any carbonaceous material can be utilized as feedstock for the embodiments described herein. In some embodiments, the carbonaceous material is coal, which without limitation includes lignite, bituminous coal, sub-bituminous coal, and any combinations thereof. Additional carbonaceous materials may include coke derived from coal, coal char, coal liquefaction residue, particulate carbon, petroleum coke, carbonaceous solids derived from oil shale, tar sands, pitch, biomass, concentrated sewer sludge, bits of garbage, rubber and mixtures thereof. The foregoing exemplified materials can be in the form of comminuted solids.

When coal or petroleum coke is the feedstock, it can be pulverized and fed as a dry solid or ground and slurried in water before addition to the reactor upper section. In general, any finely-divided carbonaceous material may be used, and any of the known methods of reducing the particle size of particulate solids may be employed. Examples of such methods include the use of ball, rod and hammer mills. While particle size is not critical, the particles should be small enough to allow entrainment of the particles in the gas stream. Finely divided carbon particles are preferred for improved reactivity. Powdered coal used as fuel in coal-fed power plants is typical. Such coal has a particle size distribution such that 90% (by weight) of the coal passes through a 200 mesh sieve. A coarser size of 100 mesh average particle size can also be used for more reactive materials, provided that a stable and non-settling slurry can be prepared.

The embodiment described above with respect to FIG. 1 includes a pressure build via a standpipe followed by continuous, controllable, and measurable flow via a fluidized-bed distribution vessel. The ability to provide a pressure build as well as continuous, controllable and measurable flow may also be provided by a recycle system having a partially fluidized standpipe, an embodiment of which is illustrated in FIG. 2 and described below.

Figure 2:
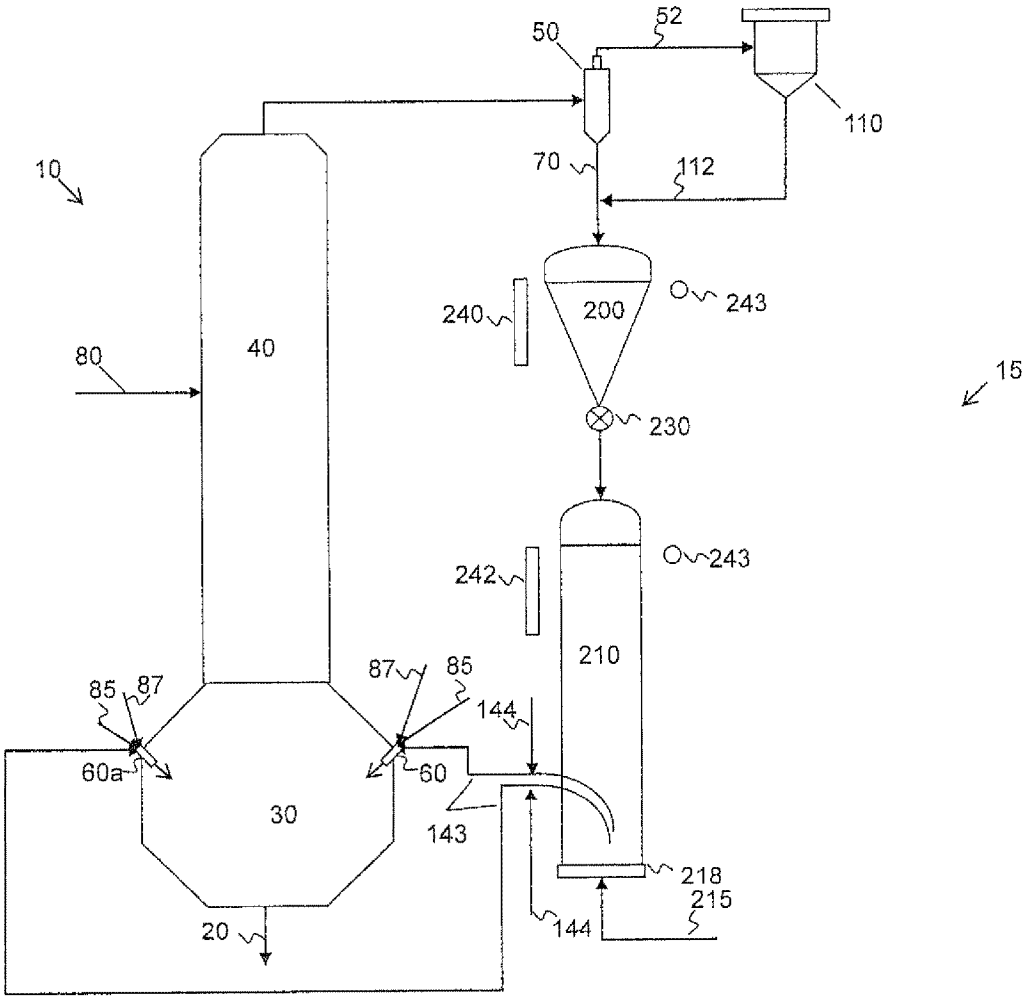
FIG. 2 is a simplified process flow diagram of a gasification system including an alternate char recycling system according to embodiments disclosed herein.

Referring now to FIG. 2, where like numerals represent like parts, a simplified process flow diagram of a gasification system, including a char recycle system according to one or more embodiments herein, is illustrated, which may be capable of operating continuously, utilizing a standpipe to generate head pressure to move solids from a lower pressure to a higher pressure environment, and the solids from the system can be fed to multiple locations simultaneously with flow rates that are precisely controlled. In this embodiment, the char recycle system 15 includes a holding vessel 200 into which the solids from a cyclone separator 50 are emptied. A partially fluidized standpipe 210 may be placed underneath holding vessel 200, and multiple conveying lines 143 may be emitting from the bottom part of the fluidized standpipe.

The holding vessel 200 may be a conical-shaped vessel with a capacity of approximately 15-30 minutes solids storage, for example. Holding vessel 200 may be separated from the partially fluidized standpipe 210 by a quick-opening block valve 212, for example, that may be remotely controlled. The partially fluidized standpipe 210 may be a vertical cylindrical vessel in which the solids are held and fluidized with a gaseous medium, such as nitrogen or syngas, introduced at the bottom of the partially fluidized standpipe 210 via flow line 215. The height of the standpipe should be tall enough to accumulate a solids level that generates sufficient static head pressure at the bottom of the standpipe to transport the solids to the higher pressure environment (e.g., the gasifier 10, such as to lower reaction section 30 of gasifier 10). The diameter of the partially fluidized standpipe should be large enough that the movement of the solids in the partially fluidized standpipe 210 is not hindered.

The bottom portion 218 of the partially fluidized standpipe 210 may be fitted with a porous medium or distribution nozzles (not shown) through which the fluidizing gas is introduced. The amount of fluidizing gas introduced via flow line 215 should be sufficient to fluidize the solids medium, but minimized so as to generate the maximum static head pressure at the bottom of the partially fluidized standpipe from the weight of the solids column (accumulated char). For example, depending upon the properties of the char, a partially fluidized standpipe could generate 1-2 psi of head pressure for every 10 feet of solids in the standpipe. As a particular example, a partially fluidized standpipe of 24 inches in diameter and 70 feet tall designed to handle a flow rate of 5,000 lb/hr of a pulverized coal may generate a pressure differential of 14.5 psi between the top and bottom of the partially fluidized standpipe.

Multiple conveying pipelines 143 may be disposed toward the bottom of the fluidized solids bed, just above the level where the fluidizing gas is introduced, to transport the solids to separate locations, such as the different burners (or dispersing devices) 60, **60*a* in a gasifier. Solids will flow in a dense phase mode through conduits 143, and a flow rate in each conveying line can be independently varied and controlled by adjusting an amount of transport gas introduced directly into the solids flow along the length of each conveying pipeline, such as via transport gas feed lines 144**. Solids flow rate in each conveying line may be measured by a solids mass flow meter.

During normal operation, a remotely-controlled pneumatic ball valve 230 between the holding vessel 200 and the partially fluidized standpipe 210 may be left open. Solids from the cyclone separator flow through the holding vessel 200 into the partially fluidized standpipe 210. The solids level in the partially fluidized standpipe 210 is held constant in the upper part of the standpipe by balancing the outflow from the bottom of the standpipe with the incoming flow from the cyclone separator and holding vessel 200. Calibration of solids flow meters may be performed similar to that described above, by temporarily closing valve 230, where a differential volume or a differential weight may be used. For example, both the holding vessel 200 and the partially fluidized standpipe 210 may be equipped with a radiometric (radiation-based) sensor 240, 242, respectively, each having a radiation source 243, to measure a level of solids in the vessels, sensors 240 and 242 providing for a volume draw-down flow rate calibration, among other functions, and sensor 240 additionally providing a level indication so as to timely conclude the calibration tests. The solids flow rate in the conveying lines coming out of the bottom of the partially fluidized standpipe 210 can be adjusted by varying the amount of fluidization gas introduced to the partially fluidized standpipe 210 via flow line 215, by varying the transport gas directly added in the conveying pipelines 143 via flow lines 144, or by varying the level of solids in the partially fluidized standpipe 210.

The embodiment described above with respect to FIG. 2, similar to the embodiment of FIG. 1, provides for both a pressure build and continuous solids transport, and thus has similar advantages. The embodiment of FIG. 2 includes a pressure build via a standpipe followed by continuous, controllable, and measurable flow via fluidization of the lower portion of the bed of particles within the partially fluidized standpipe.

Advantageously, the systems described in one or more embodiments above is capable of operating continuously, will be able to transport the solids from a lower pressure to a higher pressure environment with no cyclical pressurization and depressurization operations as required by the maintenance prone and high cost lock hopper system. The solids flow rate may also be more precisely monitored and controlled, providing enhanced reactor control as compared to slug feed resulting from pressurization and depressurization systems. The char transport systems disclosed herein may additionally provide flexibility in the gasification process, allowing a wider variety of feeds to be processed as compared to other char handling and gasification reactor systems.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A process for recycling char to a gasification reactor, the process comprising:

separating a gasification reactor effluent comprising char and syngas to produce a solids stream comprising the char and a vapor stream comprising the syngas;

feeding the char in the solids stream to a single standpipe and accumulating an amount of char within the standpipe to generate a pressure differential via the weight of the accumulated char;

recycling the char to the gasification reactor;

measuring a flow rate of the char being recycled to the gasification reactor; and adjusting a flow rate of at least one of steam, air, oxygen, or oxygen-enriched air being fed to the gasification reactor based upon the measured flow rate of the char being recycled to the gasification reactor.

2. The process of claim 1, wherein the feeding and recycling steps comprise:

feeding the char in the solids stream through a holding vessel to the standpipe;

fluidizing a portion of the accumulated amount of char in the standpipe with a fluidization medium; and recycling the char to the gasification reactor.

3. The process of claim 1, wherein the feeding and recycling steps comprise:

feeding the char in the solids stream to a standpipe;

transporting char from a bottom of the standpipe through a holding vessel to a fluidized-bed distribution vessel;

fluidizing the char within the distribution vessel with a fluidization medium; and recycling the char to the gasification reactor.

4. The process of claim 1, further comprising pulverizing a solid feedstock.

5. The process of claim 4, further comprising slurrying the pulverized solid feedstock in a coal-water slurry.

6. The process of claim 5, further comprising feeding the slurried solid feedstock to the gasification reactor.

7. The process of claim 1, further comprising calibrating a meter for measuring the flow rate via at least one of a volume differential and a weight differential of a process vessel containing char.

8. The process of claim 1, wherein the gasification reactor is a two-stage gasification reactor including a lower reaction section and an upper reaction section, the process further comprising combusting the recycled char in the lower reactor section to form a solids product comprising slag and a vapor product.

9. The process of claim 8, further comprising processing the vapor product and a fresh carbonaceous feedstock in the upper reactor section to produce the overhead product stream.

10. The process of claim 1, further comprising monitoring and controlling a flow of char to the gasification reactor as recycle using a measurement system.

11. The process of claim 1, further comprising separating residual solids from the syngas stream in a separator.

12. The process of claim 11, further comprising feeding the residual solids recovered in the separator to at least one of the standpipe and the gasification reactor.

13. The process of claim 1, wherein the fluidizing and recycling comprises dense phase transport at a velocity of less than 20 ft/s.

14. A process for recycling char to a gasification reactor, the process comprising:

separating a gasification reactor effluent comprising char and syngas to produce a solids stream comprising the char and a vapor stream comprising the syngas;

feeding the char in the solids stream to a single standpipe and accumulating an amount of char within the standpipe to generate a pressure differential via the weight of the accumulated char;

introducing a fluidizing medium via a distributor to a bottom portion of the standpipe and partially fluidizing a portion of the accumulated amount of char within the bottom portion of the standpipe with a fluidization medium;

withdrawing the partially fluidized char from within the bottom portion of the standpipe via a conveying line;

introducing a transport gas into the conveying line and transporting the char to the gasification reactor.

15. The process of claim 14, wherein a flow of the fluidizing medium introduced via the distributor to the bottom portion of the standpipe is controlled such that the partially fluidized char enters the conveying line in a dense phase flow regime.

16. The process of claim 14, further comprising adjusting a withdrawal rate of the char in the conveying line by adjusting a flow rate of the transport gas introduced into the conveying line.

17. The process of claim 14, further comprising feeding the char in the solids stream through a holding vessel to the standpipe.

* * * * *